United States Patent [19]

Simmel et al.

[11] Patent Number: 4,695,267

[45] Date of Patent: Sep. 22, 1987

[54] BATTERY-POWERED SMALL-SCALE TOY VEHICLE

[75] Inventors: Thomas L. Simmel, 44 Booras La., Milford, Conn. 06460; David W. Crossley, Pennington; Mark N. Morehouse, Ridgefield, both of N.J.

[73] Assignees: Robert S. McDarren; Barry Y. Piels, both of Ridgefield; Thomas L. Simmel, Milford, all of Conn.

[21] Appl. No.: 699,700

[22] Filed: Feb. 8, 1985

[51] Int. Cl.[4] ..... A63H 17/26

[52] U.S. Cl. ..... 446/462; 446/471

[58] Field of Search ..... 446/462, 441, 442, 457, 446/443, 470, 471, 464

[56] References Cited

U.S. PATENT DOCUMENTS

| | | | |
|---|---|---|---|
| 1,490,125 | 4/1924 | O'Leary | 446/462 X |
| 2,832,177 | 4/1958 | Mueller | 446/462 |
| 4,183,174 | 1/1980 | Barris et al. | 446/462 X |
| 4,443,968 | 4/1984 | Law | 446/462 |
| 4,472,905 | 9/1984 | Silverman et al. | 446/462 X |
| 4,492,058 | 1/1985 | Goldfarb et al. | 446/462 |
| 4,498,887 | 2/1985 | Cook | 446/462 |

FOREIGN PATENT DOCUMENTS

| | | | |
|---|---|---|---|
| 2305286 | 8/1973 | Fed. Rep. of Germany | 446/462 |
| 2426208 | 12/1974 | Fed. Rep. of Germany | 446/462 |
| 2106402 | 4/1983 | United Kingdom | 446/443 |
| 2135897 | 9/1984 | United Kingdom | 446/462 |

*Primary Examiner*—Robert E. Bagwill
*Assistant Examiner*—Terrence L. B. Brown
*Attorney, Agent, or Firm*—Blum Kaplan

[57] ABSTRACT

A chassis for scaled-down toy vehicles has the battery-powered motor mounted directly over the driven axle at a rearwardly and downwardly extended angle. The battery rests between the stub axles supporting the front, freely rotatable wheels.

20 Claims, 9 Drawing Figures

BATTERY-POWERED SMALL-SCALE TOY VEHICLE

BACKGROUND OF THE INVENTION

The present invention relates to small-scale toy vehicles. More particularly, the invention relates to a battery-powered, motor-driven wheeled chassis intended for use with a separable body in such a vehicle.

It is known to build toy vehicles in the form of models which are scaled down in size from full-sized vehicles and to power the toy vehicles by batteries. It is also known to construct a toy vehicle using a four-wheeled chassis which supports the drive motor, batteries, and a switch for connecting the batteries to the motor to propel the toy. A body, which may take many forms imitating full-sized vehicles, can then be simply attached to the chassis, providing an efficient way of minimizing the cost of each individual design.

SUMMARY OF THE INVENTION

The present invention relates to improvements in the design of toy vehicles which are scaled down to a size approximately one sixty-fourth that of a normal vehicle. The chassis of the toy vehicle of the invention can have a low profile for use, for example, with one sixty-fourth scale models of sport cars. The vehicle has a small motor of rectangular block configuration, which is mounted immediately above the driven axle and is oriented to slope downwards towards the rear of the chassis so as to conform to the streamlined body of a sports car. The shaft of the motor lies parallel to the driven axle and extends laterally therefrom on at least one side of the vehicle, where it carries a spur gear of small diameter. The motor's spur gear is positioned on the outside of the chassis and drives a larger gear which can be formed integrally with the hub of one of the rear wheels or otherwise joined to the driven axle. Each of the two wheels is fixed to the driven axle, which may be the rear axle.

The chassis is a single molding of plastic and has a flat bed which is made wide at the rear to accomodate the length of the motor and is narrower at the forward portion to accomodate the width of an AAA size electric battery. The front wheels of the vehicle are carried by individual front wheel axles which are force-fitted into integral bosses projecting outwards from either side of the narrower, forward part of the chassis. The battery is positioned low in the chassis and between the individual front wheel axles.

The motor is held in a motor mount and slopes downwardly and rearwardly relative to the floor of the chassis. The motor mount is a shell made of plastic which fits over and clamps the upper portion of the motor and is free of bottom parts which would prevent placement of the motor as near to the chassis and the axle as possible. The motor mount has a depending resilient arms carrying a transverse bar which engages a rearwards portion of the motor surface. Each depending arm also carries a lug which hooks into a notch in one of the side panels on the chassis. Another set of downward extending arms at the forward end of the motor mount carries latches which engage slots in the side panel of the chassis. The motor is formed with bosses projecting from each side thereof which rest in notches formed in the side walls of the chassis to support the motor.

One electrical connection to the motor is made by means of a frame contact which embraces a forward portion of the frame of the motor within the motor mount to provide electrical contact to one brush. The frame contact has a tab which extends downward from the motor housing to contact the surface of one battery terminal. Connection to the other brush of the motor is made via an upwards-extending contact on the inner wall of the chassis which, when the motor is in place, wipes against a brush connector on the side of the motor.

A switch for turning the motor on and off is supported within an integrally dependent housing beneath the floor of the chassis. The switch is carried on a switch bar whose end extends to the rear of the chassis, simulating an exhaust tail pipe.

Realistic toy vehicles using the teachings of the invention can be fabricated having an overall chassis length of two and three-eighths inches and an overall body length of three to three and one-eighth inches. In the case of sport car models, sloping portions of the car body may lie at distances of five-eighths of an inch above the rear axle.

The use of the spur reduction gears with the small, three-quarter inch long, three-eighths inch high, permanent magnet motor provides the toy vehicle with drive speeds which are fast enough to capture the fancy of a child and, at the same time, with power which enables the toy to climb hills. The resultant toy vehicles can be realistically scaled and are capable of running for reasonably sustained periods.

It is an object of the present invention to provide a battery-powered, small-scale toy vehicle which is driven by a miniature battery-powered electric motor, and which realistically simulates the configuration of a full-sized sport vehicle.

It is another object of the invention to provide a chassis supporting a motor and a battery for propelling a toy vehicle in a low-profile configuration which is suitable for use with a toy body mimicking the appearance of a sports car.

It is a further object of the invention to provide a one sixty-fourth scale toy vehicle capable of being driven by an AAA sized dry battery.

It is a still further object of the invention to provide a small-scale toy vehicle capable of being driven for a substantial period of time at substantial speeds by a small battery.

It is still another object of the invention to provide a chassis for a small-scale toy vehicle which permits mounting of the motor immediately above the horizontal rear drive shaft of the vehicle and at an angle which conforms to a downward, rearward sloping portion of a sports car toy vehicle body.

Another object of the invention is to provide a small-scale toy vehicle construction which requires but a few inexpensive parts.

A further object of the invention is to provide a small-scale battery-powered toy vehicle which is easily assembled in a few steps, thereby minimizing the cost of production.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
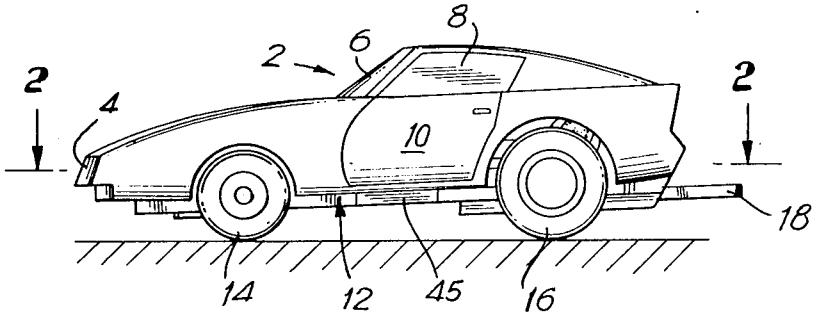
FIG. 1 is a side elevational view of a small-scale toy vehicle construction in accordance with the teachings of the invention.

Reference is now made to FIG. 1, where a side elevational view of a battery-powered, small-scale toy vehicle, fabricated in accordance with the teachings of the invention, is shown. The toy vehicle of FIG. 1 has a sport coupe body, generally designated 2, which may in the simplest of versions consist of a single molded plastic piece having bumper 4, windshield 6, side window 8, door 10, and like details which are formed in the mold. Body 2, is snap-fitted which tapers to the rear is snap-fitted onto chassis 12 which supports the vehicle's front wheels 14 and rear wheels 16 and which carries switch bar 18 projecting from its rear end like an exhaust tailpipe.

Figure 2:
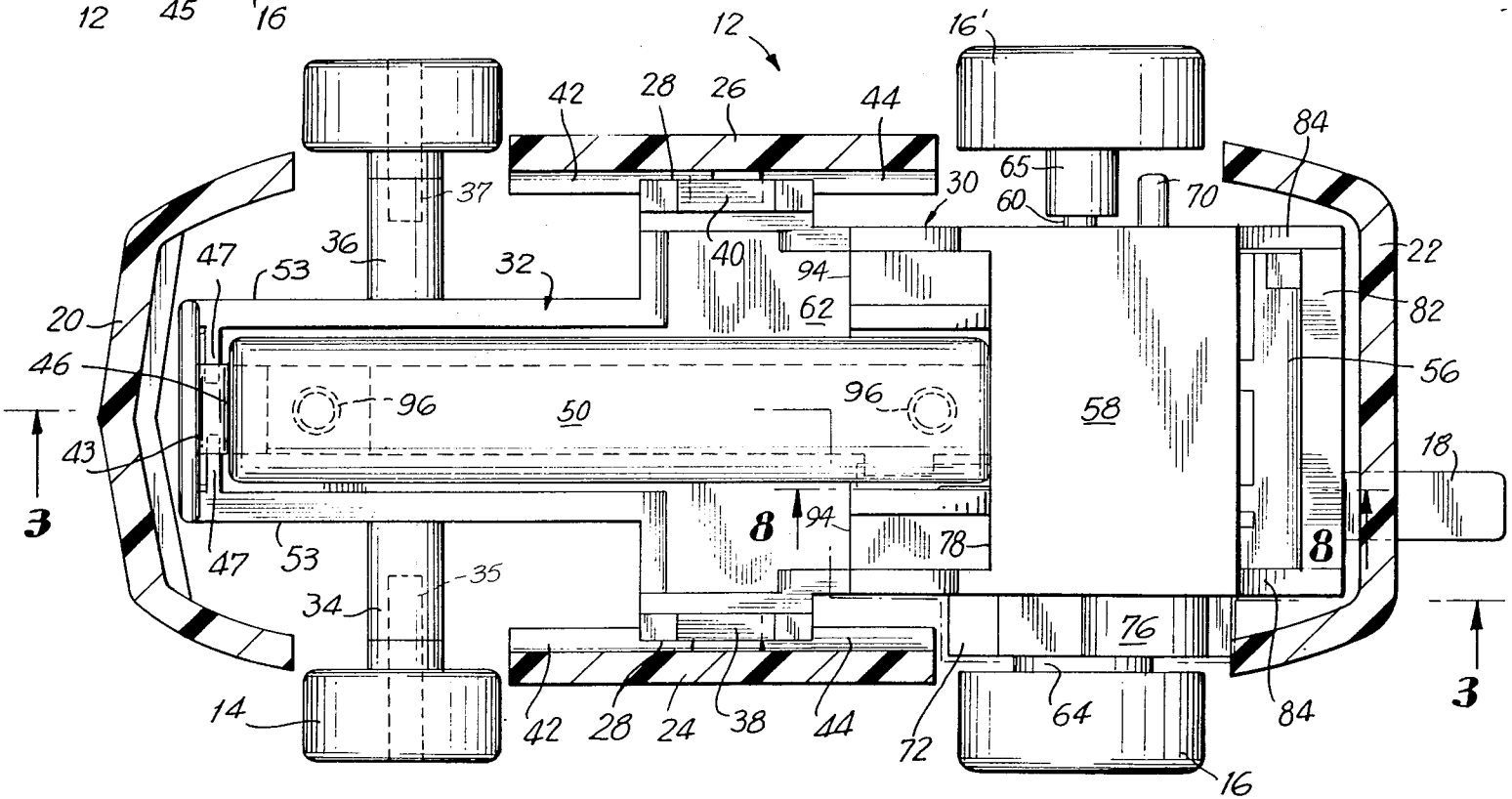
FIG. 2 is a plan view, looking downward, of the chassis of the vehicle of FIG. 1.

FIG. 2 is a view of chassis 12 from above, with the bulk of body 2 cut away. Front portion 20, rear portion 22, and left and right side portions 24 and 26 of the body are shown, however. The chassis 12 is seen to be a one piece plastic molding which has a wide rectangular rear section 30 and a relatively narrow, forward-projecting rectangular section 32 on which stubs or laterally-extending forward wheel bosses 34 and 36 are integrally molded. Front wheels 14 are each rotatably supported on an axle 35 or 37 which extends laterally from the respective stub 34 or 36. In the center of the chassis, at the point where rear section 30 joins forward section 32, lateral chassis projections 38 and 40 are provided which engage the inside surfaces 42 and 44, respectively, of body side portions 24 and 26. The location of the portion of the body which is thus engaged corresponds to kick panel 45 of FIG. 1. Since body 2 is made of a plastic material, such as an acetal, and the body walls are thin, there is some give in the side walls, permitting easy assembly and disassembly of the body from the chassis and yet providing a sufficient purchase to prevent separation of the body from the chassis as a consequency of normal rough treatment during playful use of the toy.

Figure 8:
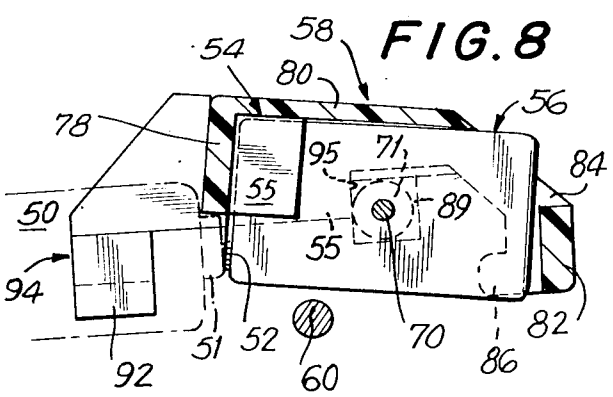
FIG. 8 is an elevational view showing details of the motor, the motor mount, and of the battery connection.

Battery 50 fits loosely within rectangular forward end 32 of chassis 12, but is firmly held between resilient, bent-over portion 46 of main contact 48 (best seen in FIG. 3) and motor frame contact tab 52 (best seen in FIG. 8). In the illustrated small-scale embodiment of the invention, battery 50 is a size AAA, 1.5 volt cell. Negative battery contact 51 abuts downward-extending tab 52 on motor frame contact 54. Motor frame contact 54 ensures a good connection between battery contact 51 and the frame of motor which is connected to one brush of the motor (not shown).

Figure 3:
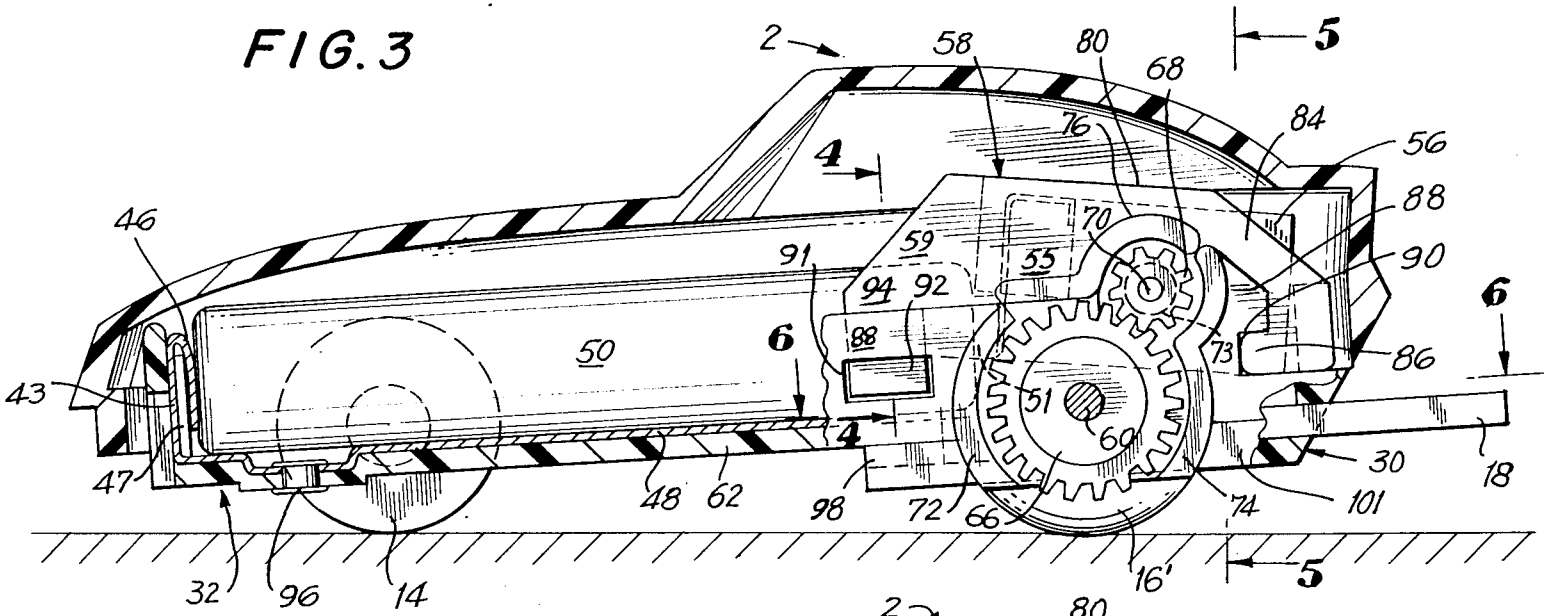
FIG. 3 is a side elevational view of the vehicle, taken in partial cross section along lines 3—3 of FIG. 2.

Drive motor 56 is held to the rear of chassis 12 by motor mount 58 and lies above drive axle 60. Drive axle 60 is journalled in holes in integral side walls 88 of rear chassis portion 30 (FIG. 6), just above chassis floor 62. Left and right rear wheels 16, 16', respectively, have hubs 64, 65, which are firmly fastened to rear axle 60. In the illustrative embodiment, rear axle 60 and rear wheels 16 and 16' are turned by main drive gear 66 formed integrally with the hub 64 of the left rear wheel 16. Main drive gear 66, in turn, is rotated by a smaller spur gear 68 (best seen in FIG. 3) which is mounted on laterally extending motor shaft 70. Motor spur gear 68 and main spur gear 66 are not visible in FIG. 2 because they are surrounded by gear guards which prevent the intrusion of small objects. Forward and rear main spur guards 72 and 74, respectively, and motor spur guard 76 are best shown in FIG. 3, where it can be seen that all but the lowest portion of drive wheel 66 are protected from the intrusion of small objects. Guards 72 and 74 are formed integrally with chassis side wall 88 and guard 76 is integral with motor mount 58.

Figure 5:
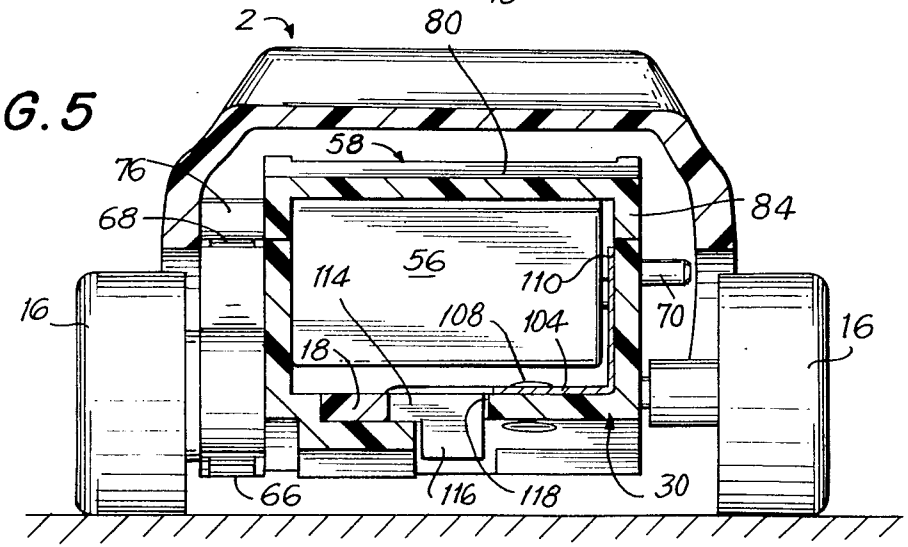
FIG. 5 is a partial sectional view along lines 5—5 of FIG. 3, showing details of the motor, the motor mount, and the switch-motor connection.

As can be seen in FIGS. 3, 5, and 8, motor 56 is mounted transversely of chassis 12 by motor mount 58 so that its front side is slightly raised. Motor mount 58 is like a shell in that it has forward transverse wall 78 and upper transverse wall 80 which meet at a right angle and which are held in position by integral side walls 55. Motor frame contact 54 is conformably fitted over the upper forward edge of the motor and inside of motor mount 58. Motor frame contact 54 also takes the form of a shell having a top wall and a forward wall, along with the integral side wall portions 55 (only one, near side wall portion 55 is visible in FIG. 8). Drive motor 56 and frame contact 54 are retained in place in motor mount 58 by forward pressure supplied by transverse motor holding bar 82 at the rear of motor mount 58. Each end of retaining bar 82 is resiliently supported at the rear of motor mount 58 between downward-angled arms 84 which are integrally formed with motor mount top 80 and side walls 59, leaving a gap therebetween through which the upper rear corner of motor 56 can project, thereby reducing the rear profile of the assembled chassis. Support arms 84 are somewhat resilient and will flex under pressure, so that, during assembly, motor mount 58 and motor frame contact 54 can be easily pressed into the embrace of the motor mount. If, for reasons of cost, it is desired to eliminate motor frame contact 54, relying instead on direct contact of battery terminal 1 with the rough frame surface of motor 56, it will be understood that the appropriate inside dimensions of motor mount 58 will be reduced.

Figure 4:
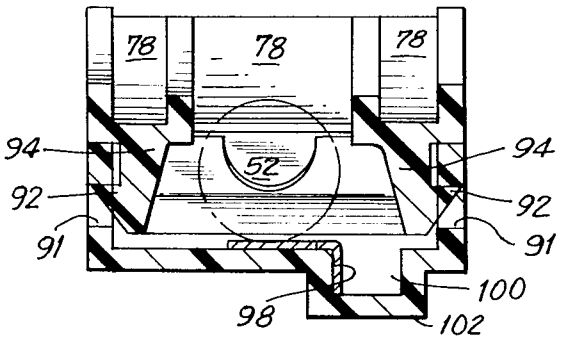
FIG. 4 is a partial sectional view along lines 4—4 of FIG. 3, showing details of the battery-to-motor connection and of the forward motor mount latches.

Located on either end of motor mount holding bar 82 below side arms 84 are forward-extending lugs 86 which, when the motor mount is positioned, engage rearward-facing cut-outs 90 (only one is shown) in chassis side walls 88. As can be seen in FIGS. 3, 4, and 8, the forward end of motor mount 58 is provided with a pair of downward-extending arms 94, each of which carries, at either side of the chassis, a laterally-extending wedge-shaped latch 92. Each latch 92 engages in a longitudinal slot 91 in one of the chassis side walls 88. When motor 56 and motor mount 58 have been assembled, the motor mount is fastened in place on the chassis by first hooking lugs 86 in recesses 90 and then pressing downwards on the motor mount to engage latch members 92 in slots 91. Motor 56 is formed with bosses 71, 73, respectively projecting transversely from each end thereof (see FIGS. 3 and 8), through which motor shaft 70 is journalled. The bosses rest in notches 89 (only one of which is shown in FIG. 8) formed in side walls 88,; the rearward edges 95 (only one is visible in FIG. 8) of motor mount side walls 55 also serve to position motor bosses 71. When motor mount 58 is coupled to chassis 12, the upper wall 80 thereof defines the desired angle of motor 56 and bears on the top surface of motor 56. Thus, even if motor 56 is not tightly retained in motor mount 58, the motor will be properly positioned by notches 89 and upper wall 80. In this way, motor 56 is positioned above drive axle 70, angled downward and to the rear, so that motor spur gear 68 is engaged with main spur gear 66.

Figure 6:
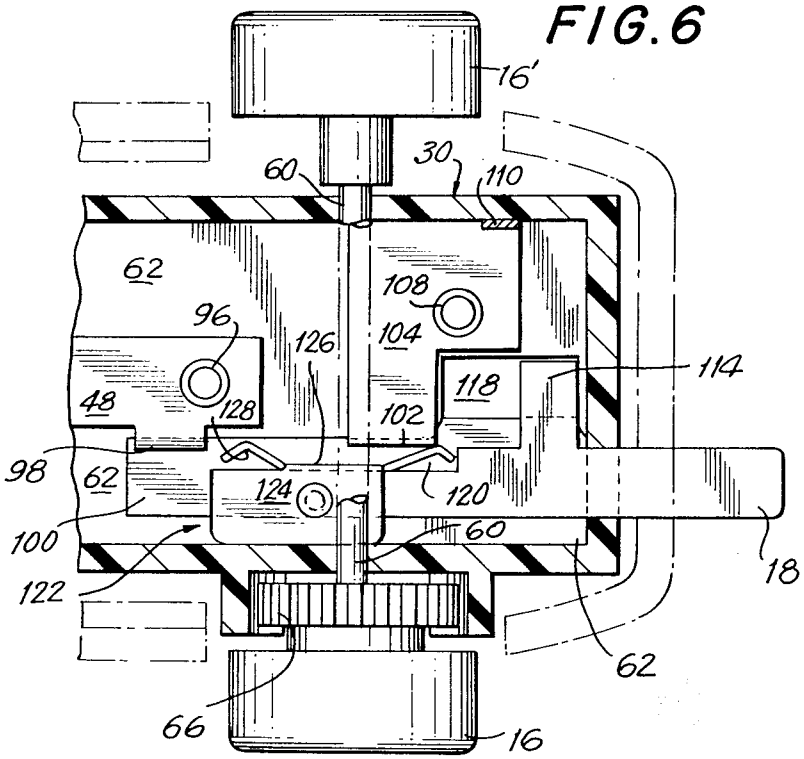
FIG. 6 is a partial sectional view along lines 6—6 of FIG. 3, showing the vehicle control switch in an open position.
Figure 7:
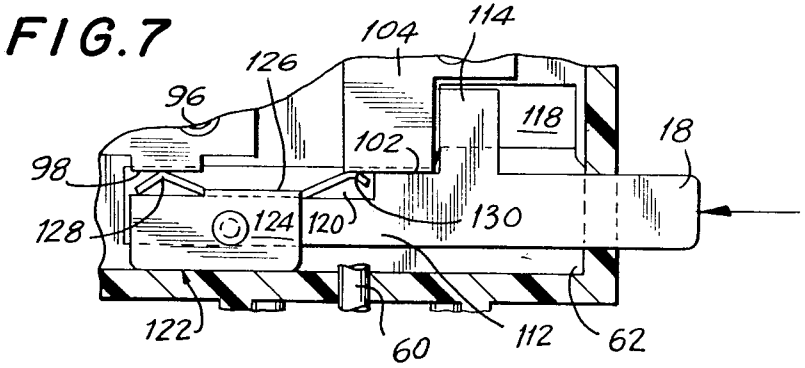
FIG. 7 is a view similar to that of FIG. 6, but showing the vehicle control switch in a closed position.

Electricity for driving the motor is supplied from the battery as follows. An electrical contact on the forward end of dry cell 50 engages the inner surface of resilient, bent-over portion 46 of main contact 48 (see FIGS. 2 and 3). A pair of partitions 47 extend inward from adjacent chassis walls 51 into the space between vertical forward portion 43 of main contact 48 and bent-over, resilient portion 46, and serve to limit forward travel of the battery produced, for example, by a collision, so as to keep the battery from moving out of place. From the front of the chassis, main contact 48 extends towards the motor, on the inner surface of chassis floor 62, to a point forward of rear axle 60. Main contact 48 is held on chassis floor 62 by means of rivets 96. As shown in FIGS. 3, 4, and 6, main contact 48 is provided, at the rear, with laterally-extending rectangular tab 98 which is bent downwards into switch bar channel 100 in switch housing 101, molded to the underneath of chassis 12. Also extending downward into channel 100 (FIGS. 6 and 7) is laterally-extending rectangular tab 102 which is bent downwards from motor connector 104. Motor connector 104 lies on the surface of chassis floor 62. Upward-extending resilient contact 110 on motor connector 104 engages motor contact tab 106 on motor 56, sliding into engagement when motor mount 58 is put in place. Motor contact 104 is fastened to chassis 12 by means of rivet 108. Resilient contact 110 of motor connector 104 is preferrably bowed slightly inwards (not shown) to ensure positive contact with motor tab 106.

Toy vehicle motor 56 is operated by means of switch bar 18 which has longitudinally extending body 112 and laterally extending lug 114. Depending portion 116 of switch leg 114 projects into opening 118 in the chassis floor and functions to limit the travel of the switch bar. Carried in forward cut-out 120 of switch bar body 112 is switch contact member 122. Switch contact member 122 has upper longitudinal plate 124 which is secured to switch bar 112 and which supports downward extending tab portion 126. Spring contact wipers 128 and 130 are carried at the front and at the rear of tab 126 for respectively engaging main contact tab 98 and motor contact tab 102 when switch bar 18 is pushed in, thereby closing the current between battery 50 and motor 56; see FIG. 7. When switch bar 18 is pulled out, the motor is off, see FIG. 6.

Figure 9:
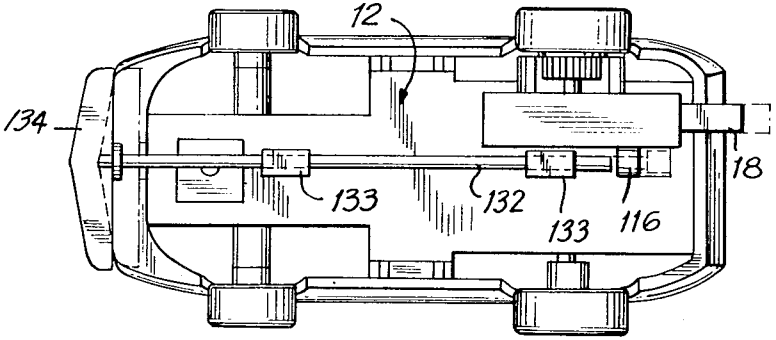
FIG. 9 is a plan view of the bottom of a second embodiment of the invention, illustrating bumper actuation of the vehicle control switch.

As an additional feature, a toy vehicle fabricated in accordance with the invention can be made to turn itself off when it runs into an object. As shown in FIG. 9, this is provided for by means of longitudinally extending contact rod 132 which is slidably mounted in sleeves 133 molded onto the bottom surface of chassis 12. When the end of contact rod 128 is moved to the rear by contact with an object, it pushes on stop member 116 of switch bar 18, which extends out of slot 116 for the purpose, thereby moving switch bar 18 out and opening the motor control switch. If the contact rod is used alone, it need only extend a short distance in front of the vehicle. However, it is preferable to complete the imitiation of a full-sized vehicle by mounting a plastic bumper 134 for back-and-forth motion on the front of the vehicle and causing the bumper to transmit the motion of a bump to control rod 18.

The toy vehicle thus formed is capable of relatively long duration use at relatively high speeds powered only by a single AAA sized battery, and may be small in size, such as a one sixty-fourth scale model.

It will thus be seen that the objects set forth above, among those made apparent from the preceding description, are effeciently attained and, since certain changes may be made in the above article without departing from the spirit and scope of the invention, it is intended that all matter contained in the above description and shown in the accompanying drawings shall be interpreted as illustrative and not in a limiting sense.

What is claimed is:

1. A chassis for use in a toy vehicle powered by a battery, the chassis having a floor and a pair of integral side walls on the floor which support an axle carrying a pair of driven rear wheels, the axle and the wheels being driven by a main spur gear and a pair of free-turning front wheels spaced apart from the driven wheels, each side wall having an upward-facing notch, the chassis further comprising:

means for releasably supporting the battery on the chassis on the forward side of the axle of the driven wheels;

electric motor means having a motor spur gear for coupling rotation to the driven wheels, the electric motor means further having a pair of outwardly and oppositely extending bosses, each boss of the pair of bosses being received in one of the notches of the side walls;

conductor means for making electrical connection between the electric motor means and the battery; and motor mount means releasably coupled to the side walls, the motor mount means clamping the electric motor means immediately above the axle of the driven wheels so that the main spur gear is engaged by the motor spur gear and so that the electric motor means may be connected to the battery and so that there is no interposition of parts between the bottom of the electric motor means and the underlying axle.

2. A chassis for use in a toy vehicle in accordance with claim 1 in which the electric motor means is rectangular in configuration and in which the motor mount means suspends the electric motor means over the axle of the driven wheels at a rearwardly and downwardly extending angle.

3. A chassis for use in a toy vehicle in accordance with claim 1 in which the electric motor means comprises a shaft and at least two transverse surfaces which lie parallel to the shaft, and in which the motor mount means clamps onto the transverse surfaces of the electric motor means to suspend the electric motor means above the axle.

4. A chassis for use in a toy vehicle in accordance with claim 3, the clamping means further comprising:

a plane surface engaging one of the transverse surfaces; and transverse bar means pressing against the other transverse surface.

5. A chassis for use in a toy vehicle in accordance with claim 1 in which the chassis is provided with:

side walls projecting upward for retaining the battery;

a pair of bosses projecting outwardly and laterally from the side walls, a stub axle on the end each boss on which a front wheel is supported, the battery extending between the bosses.

6. A chassis for use in a toy vehicle in accordance with claim 2 and further comprising:

means for releasably coupling the motor mount means to the side walls.

7. A chassis for use in a toy vehicle in accordance with claim 6 in which the side walls are each provided with at least one surface in the region of the axle which faces at least in part downward and further comprising:

detent means on the motor mount means for engaging the downward facing surface.

8. A chassis for use in a toy vehicle in accordance with claim 7 in which the downward facing surface is positioned forward of the axle and further comprising:

at least one other downward facing surface located to the rear of the axle; and an upward facing surface on the motor mount means for engaging the other downward facing surface.

9. A chassis for use in a toy vehicle in accordance with claim 2 and further comprising:

guard means for preventing entry of small objects into the gears, the guard means extending laterally from the motor mount means and positioned above the motor spur gear.

10. A chassis for use in a toy vehicle in accordance with claim 2 and further comprising side walls projecting upwardly from the chassis for retaining the battery, a pair of bosses projecting outwardly and laterally from the side walls, a stub axle supported on each end boss and supporting the front wheels, the battery extending between the bosses.

11. A chassis for use in a toy vehicle in accordance with claim 1 in which the main spur gear is located between one of the driven wheels and the adjacent side wall of the chassis, and further comprising:

guard means on the side wall which is adjacent to the main spur gear, the guard means extending over the main spur gear for preventing entry of small objects into the teeth thereof.

12. A chassis for use in a toy vehicle in accordance with claim 1 in which the battery is supported on the chassis forward of the electric motor means so as to lie between the front wheels and in which the conductor means comprises resilient contact means for contacting a terminal of the battery which lies away from the electric motor means.

13. A chassis for use in a toy vehicle in accordance with claim 12 in which an opposite terminal of the battery is proximate to the frame of the motor means, and further comprising:

contact tab means on the frame of the electric motor means for making electrical connection to the opposite terminal.

14. A chassis for use in a toy vehicle in accordance with claim 12, and further comprising:

switch means coupled to the conductor means for selectively closing the connection between the battery and motor means, the switch means including a displacable switch actuator extending longitudinally of the chassis and projecting rearwardly thereof at a position simulating a tail pipe.

15. A chassis for use in a toy vehicle in accordance with claim 14, and including a further switch actuator coupled to the first mentioned switch actuator and supported on the chassis, the further switch actuator projecting forwardly from the chassis for actuation to open the connection between the motor means and the battery when the front of the vehicle strikes an object.

16. A chassis for use in a toy vehicle in accordance with claim 12, in which the frame of the motor means is electrically conducting and is connected to one of the brushes of the motor, and the conducting means further comprises:

means supported between the motor means and the motor mount means and extending along a surface of the frame of the motor means to insure connection of the rearward terminal of the battery to the frame of the motor means.

17. A chassis for use in a toy vehicle in accordance with claim 16 wherein the means for supporting said battery is dimensioned to receive an AAA size battery.

18. A chassis for use in a toy vehicle in accordance with claim 1 wherein the means for receiving said battery is dimensioned to receive an AAA sized battery.

19. A chassis for use in a toy vehicle in accordance with claim 1 a pair of front wheels spaced apart from the drive wheels, each front wheel of the pair of front wheels being mounted on a stub-supported axle which extends outwards from the respective side wall means and the means for supporting an electric battery is located between the side walls so as to be positioned between the front wheels.

20. A chassis for use in a toy vehicle in accordance with claim 1 and further comprising:

an upper wall in the motor mount means which slopes downward and toward the rear of the chassis for engaging the top of the electric motor means to position the electric motor means at said angle.

* * * * *